US005945963A

United States Patent [19]

Leisten

[11] Patent Number: 5,945,963

[45] Date of Patent: Aug. 31, 1999

[54] DIELECTRICALLY LOADED ANTENNA AND A HANDHELD RADIO COMMUNICATION UNIT INCLUDING SUCH AN ANTENNA

[75] Inventor: Oliver Paul Leisten, Duston, United Kingdom

[73] Assignee: Symmetricom, Inc., San Jose, Calif.

[21] Appl. No.: 08/664,104

[22] Filed: Jun. 13, 1996

[30] Foreign Application Priority Data

Jan. 23, 1996 [GB] United Kingdom ..... 9601250

[51] Int. Cl.[6] ..... H01Q 1/36

[52] U.S. Cl. ..... 343/895; 343/702

[58] Field of Search ..... 343/702, 742, 343/866, 895, 821, 741

[56] References Cited

U.S. PATENT DOCUMENTS

| | | | |
|---|---|---|---|
| 2,575,377 | 11/1951 | Wohl | 343/895 |
| 2,763,003 | 9/1956 | Harris | 343/895 |
| 3,633,210 | 1/1972 | Westerman | 343/895 |

(List continued on next page.)

FOREIGN PATENT DOCUMENTS

| | | | |
|---|---|---|---|
| 0051018 | 5/1982 | European Pat. Off. . | |
| 0 241 921 A1 | 10/1987 | European Pat. Off. | H01Q 19/185 |
| 0429255 | 11/1990 | European Pat. Off. . | |
| 0465658 | 1/1992 | European Pat. Off. . | |
| 0 469 741 A1 | 2/1992 | European Pat. Off. | H01Q 11/08 |
| 0521511 | 1/1993 | European Pat. Off. . | |
| 0320404 | 3/1993 | European Pat. Off. . | |
| 0588465 | 3/1994 | European Pat. Off. . | |
| 0590534 | 4/1994 | European Pat. Off. . | |
| 5588408 | 7/1990 | Japan . | |
| 95249973 | 6/1995 | Japan . | |
| 762415 | 11/1956 | United Kingdom . | |
| 840850 | 7/1960 | United Kingdom . | |
| 1198410 | 7/1970 | United Kingdom . | |
| 1568436 | 5/1980 | United Kingdom . | |
| 2202380 | 9/1988 | United Kingdom . | |
| 2196483 | 3/1990 | United Kingdom . | |
| 2246910 | 2/1992 | United Kingdom . | |
| 2292638 | 2/1996 | United Kingdom . | |
| 9111038 | 7/1991 | WIPO . | |
| 9205602 | 4/1992 | WIPO . | |
| 9217915 | 10/1992 | WIPO . | |
| 9322804 | 4/1993 | WIPO . | |
| 9427338 | 5/1994 | WIPO . | |

OTHER PUBLICATIONS

Nakano, Hisamatsu, Helical and Spiral Antennas—A Numerical Approach, Research Studies Press Ltd.

Krall, McCorkel, Scarzello, Syeles, Communications, IEEE Transactions on Antennas and Propagation, vol. AP–27, No. 6, Nov., 1979.

Casey, Square Helical Antenna with a Dielectric Core, IEEE Transactions on Electromagnetic Compatibility, vol. 30, No. 4, Nov. 1988.

*Primary Examiner*—Don Wong
*Assistant Examiner*—Tan Ho
*Attorney, Agent, or Firm*—Wilson Sonsini Goodrich & Rosati

[57] ABSTRACT

A miniature antenna for operation at frequencies in excess of 200 MHz has a ceramic core in the form of a cylindrical rod having a relative dielectric constant greater than 5. Plated on the outer surfaces of the core is an antenna element structure comprising a single pair of oppositely disposed helical elements having a common central axis coincident with the central axis of the core. At a distal end of the antenna, they are connected to a coaxial feeder structure passing axially through the core, and at their proximal ends they are connected to the rim of a cylindrical trap conductor which, at the proximal end of the core is coupled to the screen of the feeder structure. At the operating frequency, the antenna behaves as a loop, the radiation response having nulls directed generally perpendicularly on each side of a plane containing the central axis of the core and the connections of the 6 helical elements with the feeder structure and with the conductive sleeve. The antenna is intended primarily for a handheld communication unit such as a cellular or cordless telephone handset, the presence of the nulls in the radiation pattern reducing radiation into the user's head.

39 Claims, 3 Drawing Sheets

U.S. PATENT DOCUMENTS

| | | | |
|---|---|---|---|
| 3,906,509 | 9/1975 | DuHammel | 343/895 |
| 4,008,479 | 2/1977 | Smith | 343/895 |
| 4,160,979 | 7/1979 | Drewett | 343/788 |
| 4,204,212 | 5/1980 | Sindoris et al. | 343/700 MS |
| 4,270,128 | 5/1981 | Drewett | 343/702 |
| 4,323,900 | 4/1982 | Krall et al. | 343/700 MS |
| 4,349,824 | 9/1982 | Harris | 343/700 MS |
| 4,442,438 | 4/1984 | Siwiak et al. | 343/792 |
| 4,608,574 | 8/1986 | Webster et al. | 343/895 |
| 4,862,184 | 8/1989 | Ploussios | 343/745 |
| 4,940,992 | 7/1990 | Nguyen et al. | 343/803 |
| 4,980,694 | 12/1990 | Hines | 343/702 |
| 5,081,469 | 1/1992 | Bones | 343/895 |
| 5,099,249 | 3/1992 | Seavey | 343/700 MS |
| 5,134,422 | 7/1992 | Auriol | 343/895 |
| 5,255,005 | 10/1993 | Terret et al. | 343/895 |
| 5,258,728 | 11/1993 | Taniyoshi et al. | 343/715 |
| 5,298,910 | 3/1994 | Takei et al. | 343/895 |
| 5,329,287 | 7/1994 | Strickland | 342/752 |
| 5,341,149 | 8/1994 | Valimaa et al. | 343/895 |
| 5,345,248 | 9/1994 | Hwang et al. | 343/895 |
| 5,346,300 | 9/1994 | Yamamoto et al. | 343/895 |
| 5,349,361 | 9/1994 | Egashira et al. | 343/895 |
| 5,349,365 | 9/1994 | Ow et al. | 343/715 |
| 5,406,296 | 4/1995 | Egashira et al. | 343/715 |
| 5,406,693 | 4/1995 | Egashira et al. | 29/600 |
| 5,450,093 | 9/1995 | Kim | 343/895 |
| 5,479,180 | 12/1995 | Lenzing et al. | 343/729 |
| 5,541,613 | 7/1996 | Lam et al. | 343/895 |
| 5,612,707 | 3/1997 | Vaughan et al. | 343/895 |

DIELECTRICALLY LOADED ANTENNA AND A HANDHELD RADIO COMMUNICATION UNIT INCLUDING SUCH AN ANTENNA

FIELD OF INVENTION

This invention relates to an antenna for operation at frequencies in excess of 200 MHz, and to a radio communication unit including the antenna.

BACKGROUND OF THE INVENTION

The antenna requirements of a cellular or cordless telephone handset are primarily that it should be compact and omnidirectional. For a handset operating within the frequency range of 800 MHz to 2 GHz the antenna is typically an extendable rod having a length approximately equivalent to the a quarter wavelength when extended, or a helical wire having several turns. The antenna is usually mounted partially within the handset unit and partly projecting from the end of the unit adjacent the earphone. One difficulty with radio telephone handsets is the perceived health hazard associated with prolonged irradiation of the user's head by the intense electric and magnetic fields generated close to the antenna. Typically, 90 per cent of the radiated power is absorbed by the head, particularly by the blood-rich parts such as the ears and lips. Absorption of radiation by the head can also lead to radiation inefficiency and consequent reduction of the operating range of the handset, depending on the orientation of the handset and user with respect to the nearest base station.

Other antennas for operation within the frequency range (800 MHz to 2 GHz) employed by cellular telephones include the so-called Inverted-F antenna. This has two resonant patches, one spaced above the other. However, the antenna is mechanically bulky.

In co-pending U.S. application Ser. No. 08/351,631 there is disclosed a miniature satellite navigation antenna having elements formed by four helical conductive tracks on the outer surface of a ceramic rod made of a material with a relative dielectric constant of 36. The helical elements are arranged primarily for receiving circularly polarised signals.

One of the objects of the present invention to provide an improved radio telephone handset antenna which results in reduced radiation into the user's head.

SUMMARY OF THE INVENTION

According to a first aspect of this invention, an antenna for operation at frequencies in excess of 200 MHz comprises an electrically insulative core of a material having a relative dielectric constant ($\in_r$) greater than 5, and an antenna element structure disposed on or adjacent the outer surface of the core, the material of the core occupying the major part of the volume defined by the core outer surface, wherein the antenna element structure comprises a single pair of elongate antenna elements disposed in an opposing configuration on or adjacent the core outer surface and interconnected at respective ends so as to form together a path of conductive material around the core, the other ends of the antenna elements constituting a feed connection. In a preferred antenna in accordance with the invention, the core is cylindrical, having a central axis, and the antenna elements are co-extensive, each element extending between axially spaced-apart positions on the outer cylindrical surface of the core. The elements are preferably metallised tracks deposited or bonded onto the core and arranged such that at each of the spaced-apart positions the respective spaced-apart portions of the elements are substantially diametrically opposed. The spaced-apart portions all lie substantially in a single plane containing the central axis of the core, and the portions at one of the spaced-apart positions are connected together by a link conductor to form the loop, the portions at the other of the spaced-apart positions being coupled to feed connections for the loop by cross elements extending generally radially on an end face of the core. The feed connections may be connected to a coaxial feeder structure. The radiation pattern of the antenna has a null directed perpendicularly on each side of the plane. With the exception of the two nulls, the radiation pattern is omnidirectional.

By mounting the antenna in a telephone handset, the intensity of the radiation coupled into the user's head is substantially reduced. At the frequencies of interest (in the region of 800 to 900 MHz, and 1800 to 2000 MHz), the antenna can be constructed so as to be particularly compact. For example, a DECT (Digital European Cordless Telephone) antenna operating in the frequency region 1800–1900 MHz can typically have a length of 20.2 mm and a diameter of 5 mm, using a dielectric material having $\in_r$=36.

Thus, according to a second aspect of the invention there is provided a handheld radio communication unit having a radio transceiver, an integral earphone for directing sound energy from an inner face of the unit which, in use, is placed against the user's ear, and an antenna coupled to the transceiver and located in the region of the earphone, wherein the antenna comprises: an electrically insulative core having a relative dielectric constant ($\in_r$) greater than 5, an antenna element structure including a pair of antenna elements disposed co-extensively in an opposing configuration on or adjacent the core outer surface and connected together to form a loop, the antenna element structure thereby having a radiation pattern which has a null in a direction transverse to the antenna elements; and wherein the antenna is so mounted in the unit that the null is directed generally perpendicularly to the inner face of the unit to reduce the level of radiation of the transceiver in the direction of the user's head. In the case of the antenna core being in the form of a cylinder, which may be drum-or rod-shaped, and with a pair of co-extensive antenna elements the ends of which lie in the plane containing the central axis of the core, the plane is preferably parallel to the inner face of the unit. Providing the antenna with a trap or balun in the form of a metallised sleeve not only allows the antenna loop to be fed in a substantially balanced condition, but also reduces the effect of the comparatively small ground mass represented by the unit and provides a useful surface area for secure mounting of the antenna, e.g. by soldering or clamping.

For reasons of physical and electrical stability, the material of the core may be ceramic, e.g. a microwave ceramic material such as a zirconium-titanate-based material, magnesium calcium titanate, barium zirconium tantalate, and barium neodymium titanate, or a combination of these. The preferred relative dielectric constant ($\in_r$) is upwards of 10 or, indeed, 20, with a figure of 36 being attainable using zirconium-titanate-based material. Such materials have negligible dielectric loss to the extent that the Q of the antenna is governed more by the electrical resistance of the antenna elements than core loss.

A particularly preferred embodiment of the invention has a cylindrical core of solid material with an axial extent at least as great as its outer diameter, and with the diametrical extent of the solid material being at least 50 per cent of the outer diameter. Thus, the core may be in the form of a tube having a comparatively narrow axial passage of a diameter at most half the overall diameter of the core.

While it is preferred that the antenna elements are helical, with each element executing a half-turn around the core, it is also possible to form the elements such that they are parallel to the central axis and still achieve a radiation pattern having a null which is directed transversely to the axis, as in the case of the above-described antenna with helical elements.

In the preferred antenna, the antenna elements are fed from a distal end, the core having a central passage housing a coaxial feeder structure extending from a proximal or mounting end of the core and opening out at the distal end where radial elements couple the antenna elements on the cylindrical outer surface of the core respectively to the inner and outer conductors of the feeder structure. The link conductor may then be annular, and advantageously is constituted by a cylindrical sleeve on the outer surface of the proximal part of the core.

The choice of antenna element configuration affects the bandwidth of the antenna, insofar as the use of helical elements tends to increase bandwidth compared with antenna elements parallel to the central axis of the core.

BRIEF DESCRIPTION OF THE DRAWINGS

Preferred embodiments of the present invention are described below by way of example with reference to the drawings.

in the drawings.

DETAILED DESCRIPTION OF THE PREFERRED EMBODIMENTS

Figure 1:
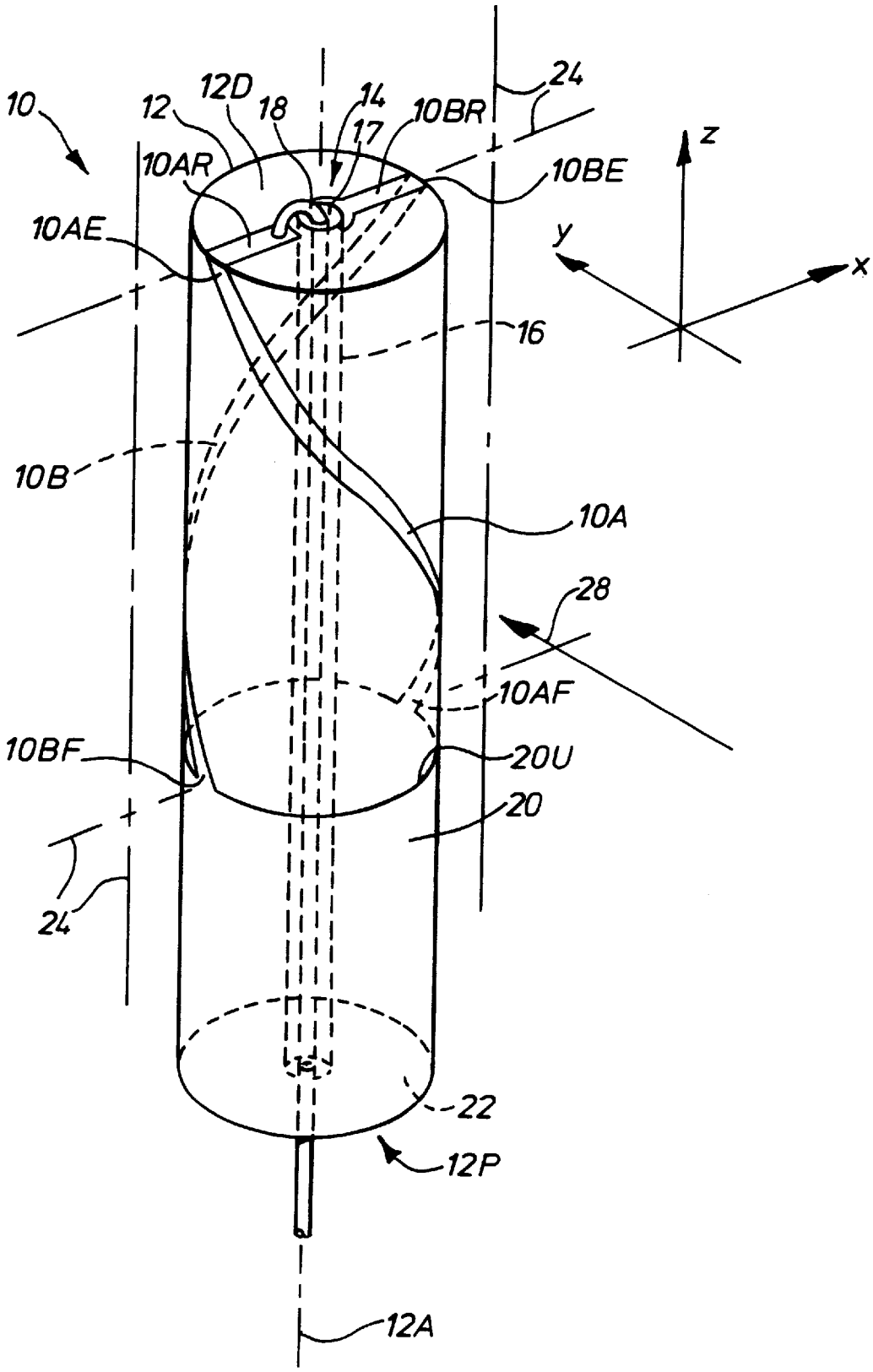
FIG. 1 is a perspective view of an antenna in accordance with the invention.

Referring to FIG. 1, an antenna 10 in accordance with the invention has an antenna element structure with two longitudinally extending antenna elements 10A, 10B formed as metallic conductor tracks on the cylindrical outer surface of a ceramic core 12. The core 12 has an axial passage 14 with an inner metallic lining 16, and the passage houses an axial inner feeder conductor 18. The inner conductor 18 and the lining 16 in this case form a feeder structure for coupling a feed line to the antenna elements 10A, 10B at a feed position on the distal end face 12D of the core. The antenna element structure also includes corresponding radial antenna elements 10AR, 10BR formed as metallic tracks on the distal end face 12D connecting diametrically opposed ends 10AE, 10BE of the respective longitudinally extending elements 10A, 10B to the feeder structure. The other ends 10AF, 10BF of the antenna elements 10A, 10B are also diametrically opposed and are linked by an annular common virtual ground conductor 20 in the form of a plated sleeve surrounding a proximal end portion of the core 12. This sleeve 20 is in turn connected to the lining 16 of the axial passage 14 by plating 22 on the proximal end face 12P of the core 12.

In this preferred embodiment, the conductive sleeve 20 covers a proximal portion of the antenna core 12, thereby surrounding the feeder structure 16, 18, the material of the core 12 filling the whole of the space between the sleeve 20 and the metallic lining 16 of the axial passage 14. The sleeve 20 forms a cylinder connected to the lining 16 by the plating 22 of the proximal end face 12P of the core 12, the combination of the sleeve 20 and plating 22 forming a balun so that signals in the transmission line formed by the feeder structure 16, 18 are converted between an unbalanced state at the proximal end of the antenna and a balanced state at an axial position approximately in the plane of the upper edge 20U of the sleeve 20. To achieve this effect, the axial length of the sleeve 20 is such that in the presence of an underlying core material of relatively high dielectric constant, the balun has an electrical length of about $\lambda/4$ at the operating frequency of the antenna. Since the core material of the antenna has a foreshortening effect, the annular space surrounding the inner conductor 18 is filled with an insulating dielectric material 17 having a relatively small dielectric constant, and the feeder structure distally of the sleeve 20 has a short electric length. As a result, signals at the distal end of the feeder structure 16, 18 are at least approximately balanced.

A further effect of the sleeve 20 is that for signals in the region of the operating frequency of the antenna, the rim 20U of the sleeve 20 is effectively isolated from the ground represented by the outer conductor 16 of the feeder structure. This means that currents circulating between the antenna elements 10A, 10B, are confined to the rim 20U and the loop formed by the antenna element structure is isolated. The sleeve 20 thus acts as an isolating trap.

In this embodiment, the longitudinally extending elements 10A, 10B are of equal length, each being in the form of a simple helix executing a half turn around the axis 12A of the core 12.

The antenna elements 10A, 10B are connected respectively to the inner conductor 18 and outer lining 16 of the feeder structure by their respective radial elements 10AR, 10BR. It will be seen, then, that the helical elements 10A, 10B, the radial elements 10AR, 10BR, and the sleeve 20 together form a conductive loop on the outer surface of the core 12, the loop being fed at the distal end of the core by a feeder structure which extends through the core from the proximal end and lies between the antenna elements 10A, 10B. The antenna consequently has an end-fed bifilar helical structure.

It will be noted that the four ends 10AE, 10AF, 10BE, 10BF ofthe antenna elements 10A, 10B all lie in a common plane containing the axis 12A of the core 12. This common plane is indicated by the chain lines 24 in FIG. 1. The feed connection to the antenna element structure also lies in the common plane 24. The antenna element structure is so configured that the integral of currents induced in elemental segments of this structure by a wave incident on the antenna from a direction 28 normal to the plane 24 and having a planar wavefront sums to zero at the feed position, i.e. where the feeder structure 16, 18 is connected to the antenna element structure. In practice, the two elements 10A, 10B are equally disposed and equally weighted on either side of the plane 24, yielding vectorial symmetry about the plane. Each element 10A, 10B may be regarded as being made up of a plurality of increments, each one of which lies diametrically opposite a corresponding complementary increment of the other of the elements 10A, 10B at an equal distance from the central axis 12A.

Figure 2:
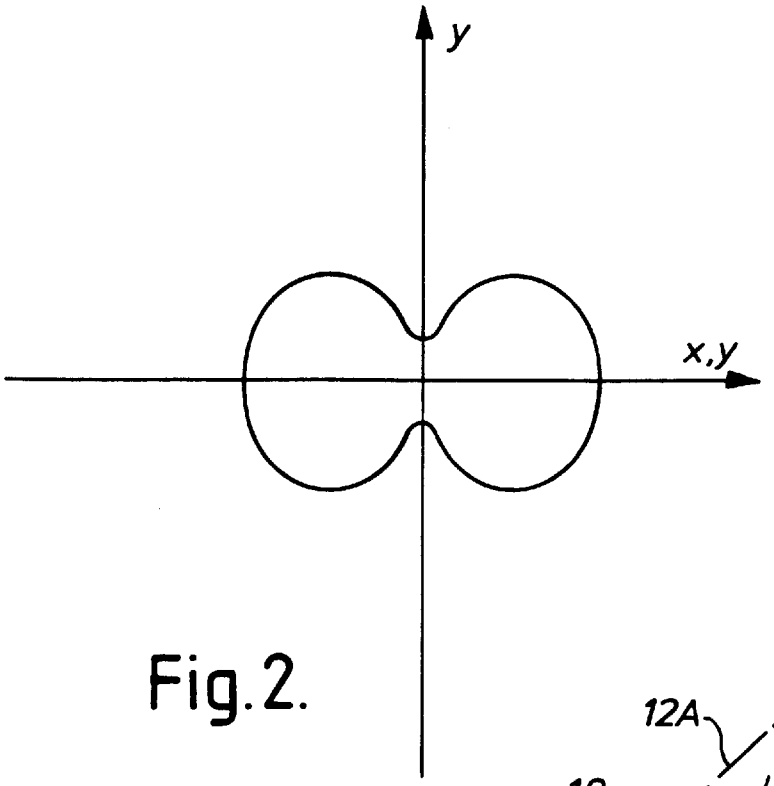
FIG. 2 is a diagram illustrating the radiation pattern of the antenna of FIG. 1.

The antenna element structure with half-turn helical elements 10A, 10B performs in a manner similar to a simple planar loop, having a null in its radiation pattern in a direction transverse to the axis 12A and perpendicular to the plane 24. The radiation pattern is, therefore, approximately of a figure-of-eight form in both the vertical and horizontal planes transverse to the axis 12A, as shown by FIG. 2. Orientation of the radiation pattern with respect to the perspective view of FIG. 1 is shown by the axis system comprising axes X, Y, Z shown in both FIG. 1 and FIG. 2. The radiation pattern has two nulls or notches, one on each side of the antenna, and each centred on the line 28 shown in FIG. 1.

Figure 3:
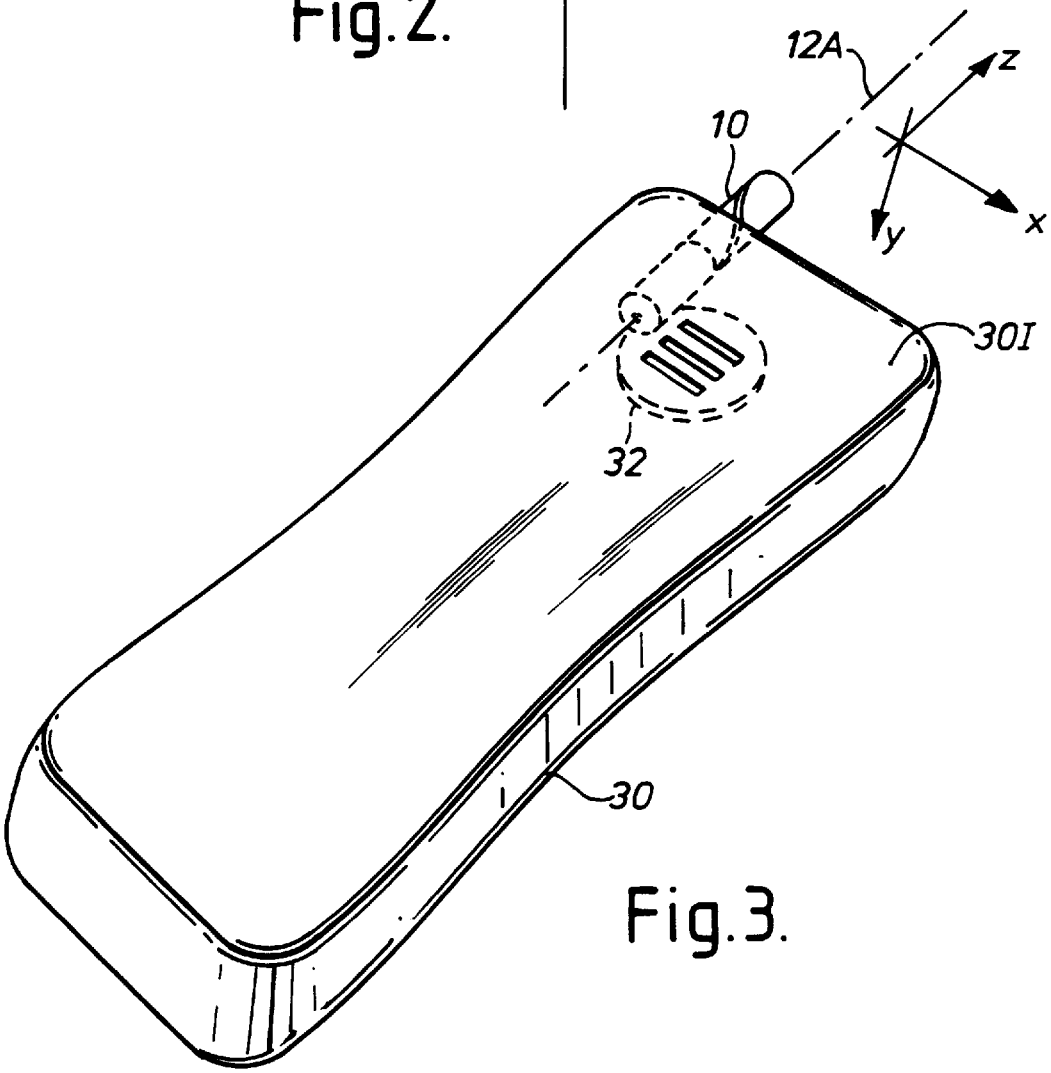
FIG. 3 is a perspective view of a telephone handset, incorporating an antenna in accordance with the invention.

The antenna has particular application at frequencies between 200 MHz and 5 GHz. The radiation pattern is such that the antenna lends itself especially to use in a handheld communication unit such as a cellular or cordless telephone handset, as shown in FIG. 3. To orient one of the nulls of the radiation pattern in the direction of the user's head, the antenna is mounted such that its central axis 12A (see FIG. 3) and the plane 24 (see FIG. 1) are parallel to the inner face 30I of the handset 30, and specifically the inner face 30I in the region of the earphone 32. The axis 12A also runs longitudinally in the handset 30, as shown. Again, the relative orientations of the antenna, its radiation pattern, and the handset 30 are evident by comparing the axis system X, Y, Z as it is shown in FIG. 3 with the representations of the axis system in FIGS. 1 and 2.

The preferred material for the core 12 of the antenna is a zirconium-titanate-based material. This material has a relative dielectric constant of 36 and is noted also for its dimensional and electrical stability with varying temperature. Dielectric loss is negligible. The core may be produced by extrusion or pressing.

The antenna elements 10A, 10B, 10AR, 10BR are metallic conductor tracks bonded to the outer cylindrical and distal end surfaces of the core 12, each track being of a width of at least four times its thickness over its operative length. The tracks may be formed by initially plating the surfaces of the core 12 with a metallic layer and then selectively etching away the layer to expose the core according to a pattern applied in a photosensitive layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

With a core material having a substantially higher relative dielectric constant than that of air, e.g. $\in_r=36$, an antenna as described above for the DECT band in the region of 1880 MHz to 1900 MHz typically has a core diameter of about 5 mm and the longitudinally extending elements 10A, 10B have a longitudinal extent (i.e. parallel to the central axis 12A) of about 12.7 mm. The width of the elements 10A, 10B is about 0.3 mm. At 1890 MHz the length of the balun sleeve 20 is typically in the region of 7.5 mm or less. Expressed in terms of the operating wavelength $\lambda$ in air, these dimensions are, for the longitudinal (axial) extent of the elements 10A, 10B: $0.08\lambda$, for the core diameter: $0.0315\lambda$, for the balun sleeve: $0.047\lambda$ or less, and for the track width: $0.00189\lambda$. Precise dimensions of the antenna elements 10A, 10B can be determined in the design stage on a trial and error basis by undertaking eigenvalue delay measurements.

Adjustments in the dimensions of the plated elements during manufacture of the antenna may be performed in the manner described in our co-pending U.S. application Ser. No. 08/351,631 with reference to FIGS. 3 to 6 thereof. The whole of the subject matter of the co-pending application is incorporated in the present application by reference.

The small size of the antenna renders it particularly suitable in handheld devices such as a mobile telephone handset and other personal communication devices. The plated balun sleeve 20 and/or the plated layer 22 on the proximal end face 12P of the core 12 allow the antenna to be directly mounted on a printed circuit board or other ground structure in a particularly secure manner. Typically, if the antenna is to be end-mounted, the proximal end face 12P can be soldered to a ground plane on the upper face of a printed circuit board with the inner feed conductor 18 passing directly through a plated hole in the board for soldering to a conductor track on the lower surface. Alternatively, sleeve 20 may be clamped or soldered to a printed circuit board ground plane extending parallel to the axis 12A, with the distal part of the antenna, bearing antenna elements 10A, 10B, extending beyond an edge of the ground plane. It is possible to mount the antenna 10 either wholly within the handset unit, or partially projecting as shown in FIG. 3.

Figure 4:
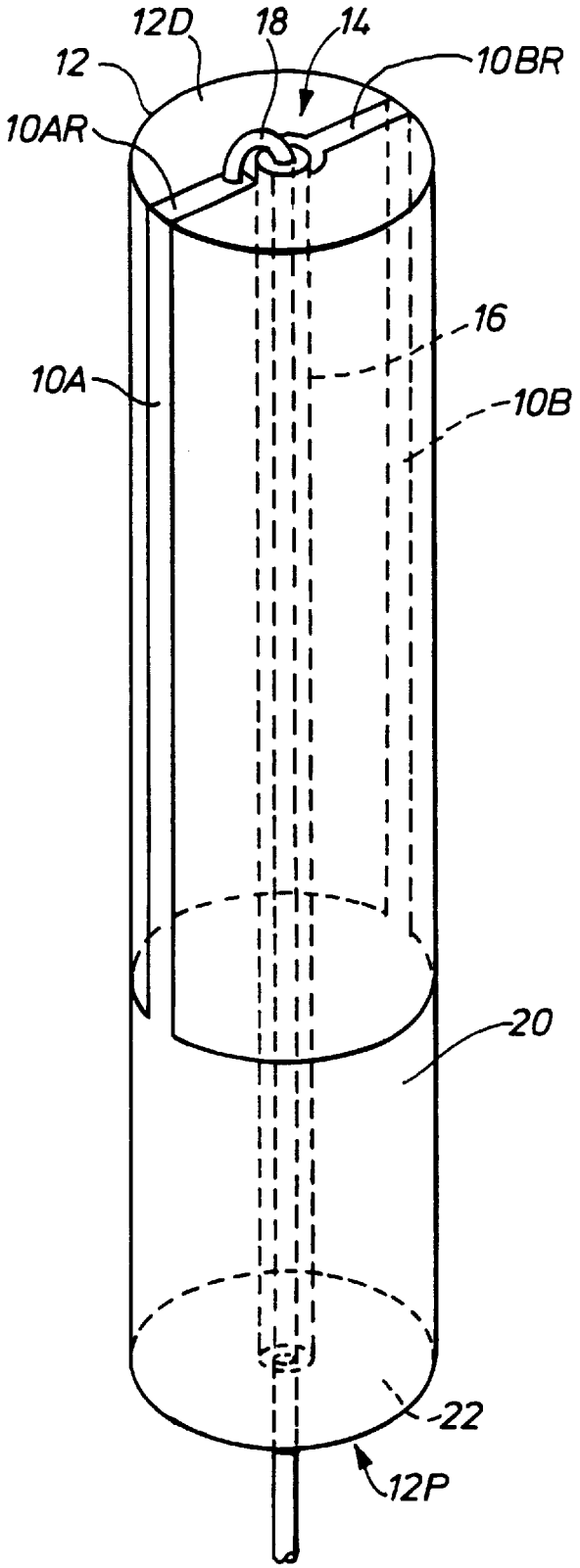
FIG. 4 is a perspective view of a second antenna in accordance with the invention.

An alternative embodiment within the scope of the invention is shown in FIG. 4.

Referring to FIG. 4, the antenna elements 10A, 10B plated on the cylindrical surface of core 12 are, in this case, parallel to the central axis 12A on opposite sides of the latter. As in the embodiment of FIG. 1, the antenna elements 10A, 10B are connected respectively to the inner and outer conductors 18, 16 of the feeder structure via radial elements 10AR, 10BR on the distal end face 12D of the core 12. Again sleeve 20 forms an isolating trap so that its upper rim forms part of a loop extending around the core from one feeder conductor 16 to the other 18. In other respects, the antenna of FIG. 4 is similar to that of FIG. 1. It has a similar radiation pattern, with nulls directed transversely of the central axis and perpendicular to the plane containing elements 10A, 10B, and the feeder structure 16, 18.

What is claimed is:

1. An antenna for operation at frequencies in excess of 200 MHz, comprising an electrically insulative core of a solid material having a relative dielectric constant greater than 5, and an antenna element structure disposed on or adjacent the outer surface of the core, the material of the core occupying the major part of the volume defined by the core outer surface, wherein the antenna element structure comprises a single pair of elongate antenna elements which are disposed in an opposing configuration on or adjacent the core outer surface and which are co-extensive, with each element extending between axially spaced-apart positions, and wherein said elongate antenna elements each have a first end and a second end, the first ends being interconnected so that said antenna elements form together a path of conductive material around the core, the second ends of the antenna elements constituting a feed connection.

2. An antenna according to claim 1, wherein the core defines the central axis, wherein the antenna elements are substantially co-extensive in the axial direction with each element extending between axially spaced-apart positions on or adjacent the outer surface of the core such that at each of the spaced-apart positions the respective spaced-apart portions of the antenna elements lie substantially in a single plane containing the central axis of the core, and wherein the antenna element structure further comprises a link conductor linking said antenna element portions at one of said spaced-apart positions to form a loop, the antenna element portions at the other of said spaced-apart positions being coupled to the feed connection.

3. An antenna according to claim 2, wherein the core is cylindrical, the axis of the cylinder constituting said central axis of the core, and wherein the respective spaced-apart portions of the antenna elements are substantially diametrically opposed.

4. An antenna according to claim 3, wherein the antenna elements are of equal length and are helical, each executing a half-turn around the core between said spaced-apart positions.

5. An antenna according to claim 3, wherein the antenna elements are parallel to the central axis of the core.

6. An antenna according to claim 3, wherein the antenna elements include radial portions lying on a single diameter and coupling said antenna element portions at the other of the spaced-apart positions to the feed connection.

7. An antenna according to claim 6, including an axial feeder structure passing through the core and connected to the antenna elements at a distal end of the core.

8. An antenna according to claim 7, wherein the link conductor is annular and connected proximally to the antenna elements.

9. An antenna according to claim 8, wherein the link conductor comprises a cylindrical conductive sleeve on a proximal part of the outer surface of the core, and wherein the proximal end of the sleeve is connected to an outer screen part of the feeder structure.

10. An antenna according to claim 1, including an integral trap arranged to promote a substantially balanced condition at the feed connection.

11. An antenna according to claim 1, including a feeder structure passing through the core and connected to said other ends of the antenna elements.

12. An antenna according to claim 1, wherein the antenna elements form a loop having a pair of side portions, and cross portions which extend between each of the side portions, the ends of the side portions defining the corners of a notional rectangle, one of the cross portions containing the feed connection.

13. An antenna according to claim 12, wherein, between their ends, the side portions extend on opposite sides of the plane of the rectangle.

14. An antenna according to claim 13, wherein each increment of each side portion has a corresponding complementary increment in the other side portion, such pairs of complementary increments being equally and oppositely spaced from a central axis of the rectangle.

15. An antenna according to claim 1, wherein the antenna elements form a loop around the core and are configured such that in the region of the feed connection and in a region opposite the feed connection, which regions are associated with a central axis of the antenna, the resultant currents in the loop travel in a common plane containing the central axis.

16. An antenna according to claim 15, wherein the elements are configured such that the resultant currents in the respective regions travel in the same and parallel directions in the common plane.

17. An antenna according to claim 15, wherein the elements are configured such that the resultant currents in the respective regions travel in parallel but opposite directions in the common plane.

18. An antenna according to claim 15, wherein the antenna elements include, in the region opposite the feed connection, conductors which extend on opposite sides of said plane between points contained in the plane and located on opposite sides of the central axis.

19. A method of manufacturing an antenna as claimed in claim 1, comprising forming the antenna core from the dielectric material, metallising the external surfaces of the core according to a pattern which forms said elongate elements and an interconnection between them.

20. A method according to claim 19, wherein the metallisation step includes coating the external surfaces of the core with a metallic material and removing portions of the coating to leave the predetermined pattern.

21. A method according to claim 19, wherein the metallisation step includes forming a mask containing a negative of the said predetermined pattern and depositing a metallic material on the external surfaces of the core while using the mask to mask portions of the core so that the metallic material is applied according to the predetermined pattern.

22. An antenna according to claim 1, having a radiation pattern with a null in a direction transverse to the central axis.

23. A radio telephone handset antenna according to claim 1.

24. An antenna according to claim 23, wherein the relative dielectric constant of the core material is greater than 10.

25. An antenna according to claim 24, wherein the relative dielectric constant of the core material is greater than 20.

26. An antenna according to claim 23, configured to have an operating frequency in the region of 800 MHz to 900 MHz.

27. An antenna according to claim 23, configured to have an operating frequency in the region of 1800 to 2000 MHz.

28. An antenna for operation at frequencies in excess of 200 MHz, comprising an electrically insulative core having a central axis and being formed of a solid material having a relative dielectric constant greater than 5, and an antenna element structure disposed on or adjacent the outer surface of the core, the material of the core occupying the major part of the volume defined by the core outer surface, wherein the antenna element structure comprises a single pair of elongate antenna elements which are disposed in an opposing configuration so that said antenna elements form a loop extending around the core and terminated at a feed connection, the antenna having a radiation pattern which is omni-directional with the exception of a null centred on a null axis passing through the core transversely with respect to said central axis.

29. An antenna according to claim 28, wherein the antenna radiation pattern is generally toroidal.

30. An antenna according to claim 28, wherein the antenna element structure is a loop which has an electrical length of 360° at its operating frequency.

31. An antenna according to claim 28, wherein the antenna element structure is a twisted loop.

32. An antenna according to claim 31, wherein the feed connection is located on said central axis, and wherein the twisted loop comprises a pair of helical conductors oppositely and symmetrically disposed about said central axis and coextensive in the direction of the said central axis, a pair of radial conductors connecting the helical conductors to the feed connection and a linking conductor spaced in the direction of said central axis from the radial conductors and linking the helical conductors together.

33. An antenna according to claim 32, wherein each of said pair of helical conductors is connected to a respective one of said radial conductors and to said linking conductor at respective diagonally opposite corners of a rectangle containing said central axis.

34. A handheld radio communication unit having a radio transceiver, an integral earphone for directing sound energy from an inner face of the unit which, in use, is placed against the user's ear, and an antenna coupled to the transceiver and located in the region of the earphone, wherein the antenna comprises:

an electrically insulative core having a relative dielectric constant greater than 5, an antenna element structure including a pair of antenna elements disposed co-extensively in an opposing configuration on or adjacent the core outer surface and connected together to form a loop, the antenna element structure thereby having a radiation pattern which has a null in a direction transverse to the antenna elements, and wherein the antenna is so mounted in the unit that the null is directed generally perpendicularly to said inner face of the unit to reduce the level of radiation from the unit in the direction of the user's head.

35. A unit according to claim 34, wherein the antenna core is in the form of a cylinder the central axis of which is substantially parallel to said inner face in the region of the earphone, and wherein the antenna elements extend between a pair of axially spaced-apart positions on the rod, with the antenna element ends at each such position being diametrically opposite each other and lying in a plane which contains the central axis and which is generally parallel to the inner face of the unit in the region of the earphone, the antenna element structure further including a link conductor linking the antenna element ends at one of the spaced-apart positions.

36. A unit according to claim 35, wherein the antenna elements are helical, each executing a half turn about the central axis, the link conductor is formed by a conductive sleeve encircling the cylinder to form an isolating trap, and the antenna elements at the other of the spaced-apart positions are coupled to an axial feeder structure passing through the core.

37. A radio telephone handset antenna comprising a substantially cylindrical electrically insulative core which is formed of a solid material having a relative dielectric constant greater than 5 and which defines a central antenna axis, and an antenna element structure disposed on or adjacent the outer surface of the core, the material of the core occupying the major part of the volume defined by the core outer surface, wherein the antenna element structure comprise a single pair of axially co-extensive and coaxial half-turn helical elements disposed in a diametrically opposed configuration, the elements being interconnected at respective ends to form a loop of conductive material around the core, the other ends of the elements constituting a feed connection, whereby the antenna constitutes a dielectrically foreshortened antenna with a radiation pattern having a null directed transversely to the axis for mounting on a handset body with the null oriented so as to be directed towards the user's head thereby to reduce radiation into the head.

38. A radio telephone handset antenna according to claim 37, including a balanced feed at the feed connection.

39. A radio telephone handset antenna according to claim 37, wherein the loop has an electrical length of 360° at an operating frequency of the antenna.

* * * * *

UNITED STATES PATENT AND TRADEMARK OFFICE

CERTIFICATE OF CORRECTION

PATENT NO. : 5,945,963

DATED : August 31, 1999

INVENTOR(S) : Leisten

It is certified that error appears in the above-identified patent and that said Letters Patent is hereby corrected as shown below:

Title page, item [57] ABSTRACT please delete the numeral "6".

Signed and Sealed this

Ninth Day of May, 2000

*Attest:*

Q. TODD DICKINSON

*Attesting Officer*

*Director of Patents and Trademarks*